US008568210B1

(12) United States Patent
Thomas, Jr. et al.

(10) Patent No.: US 8,568,210 B1
(45) Date of Patent: Oct. 29, 2013

(54) INTEGRATED VENTURI HEATING ELEMENTS FOR AIR CURTAINS

(75) Inventors: Philip M. Thomas, Jr., Cranberry Township, PA (US); David A. Johnson, New Castle, PA (US)

(73) Assignee: Berner International, Inc., New Castle, PA (US)

( * ) Notice: Subject to any disclaimer, the term of this patent is extended or adjusted under 35 U.S.C. 154(b) by 675 days.

(21) Appl. No.: 12/800,469

(22) Filed: May 17, 2010

(51) Int. Cl.
*F24F 9/00* (2006.01)

(52) U.S. Cl.
USPC ..... 454/188; 454/193; 392/360

(58) Field of Classification Search
USPC ..... 454/188–193; 392/361; 415/177
See application file for complete search history.

(56) References Cited

U.S. PATENT DOCUMENTS

| | | | | | |
|---|---|---|---|---|---|
| 1,723,405 | A * | 8/1929 | Carmean | ..... | 392/361 |
| 3,215,058 | A * | 11/1965 | Anderson | ..... | 454/192 |
| 3,332,334 | A * | 7/1967 | Melzer | ..... | 454/188 |
| 4,090,061 | A * | 5/1978 | Glucksman | ..... | 392/379 |
| 4,450,755 | A * | 5/1984 | Catan | ..... | 454/188 |
| 4,988,847 | A | 1/1991 | Argos et al. | | |
| 5,072,658 | A * | 12/1991 | Bogage | ..... | 454/188 |
| 5,984,649 | A | 11/1999 | Kato et al. | | |
| 6,014,322 | A * | 1/2000 | Higashi et al. | ..... | 363/65 |
| 7,168,917 | B2 * | 1/2007 | Bronaugh et al. | ..... | 415/200 |

* cited by examiner

*Primary Examiner* — Steven B McAllister
*Assistant Examiner* — Ko-Wei Lin
(74) *Attorney, Agent, or Firm* — Harpman & Harpman

(57) ABSTRACT

An air curtain resistant heating system including multiple heating coils integrated within blower fan cages. The multiple heating coils defining an inflow venture air pattern for increased heat transfer and fan cage internal flow vortex dependent on coil flow conveyance. Coil orientation placement assures limited impact to effect blower pressure and therefore minimizes loss of air performance parameters. Multiple phase electrical supply for multiple paired heating coils positioned in corresponding multiple blower fan units in an air curtain assembly.

5 Claims, 4 Drawing Sheets

INTEGRATED VENTURI HEATING ELEMENTS FOR AIR CURTAINS

BACKGROUND OF THE INVENTION

1. Technical Field

This invention relates to the field of air curtains used to create an airflow defined barrier in openings in buildings between interior and exterior or different conditioned spaces within the building for reduced energy use by environmental retention therebetween.

2. Description of Prior Art

Prior art devices of this type have been directed towards air curtains and associated air blower assemblies that include airstream conditioning such as heating. Typically, air curtains are limited to ambient air recirculation with the inclusion of heaters to condition the airflow as it leaves the blower through a directional outlet nozzle to form a laminar airflow barrier between openings. All known air curtain configurations condition the airflow pre or post blower, see for example U.S. Pat. No. 5,984,649.

Other heated air blower units have been developed for a variety of air heating applications with associated electric resistant coils, see for example U.S. Pat. No. 4,988,847 for defogging a bathroom mirror and well known portable electric heaters used for auxiliary point of use heating too numerous to list.

SUMMARY OF THE INVENTION

An air curtain unit with multiple blower fans having integrated heating coils positioned within intake air stream venturies defined by their interior of the impellor fan cage as such the heating coils conform to and define a venture airflow characteristic by integrated coil dimension augmentation for maximum heat transfer from respective opposing heat coil placements with minimal air outflow impact.

DETAILED DESCRIPTION OF THE INVENTION

Figure 1:
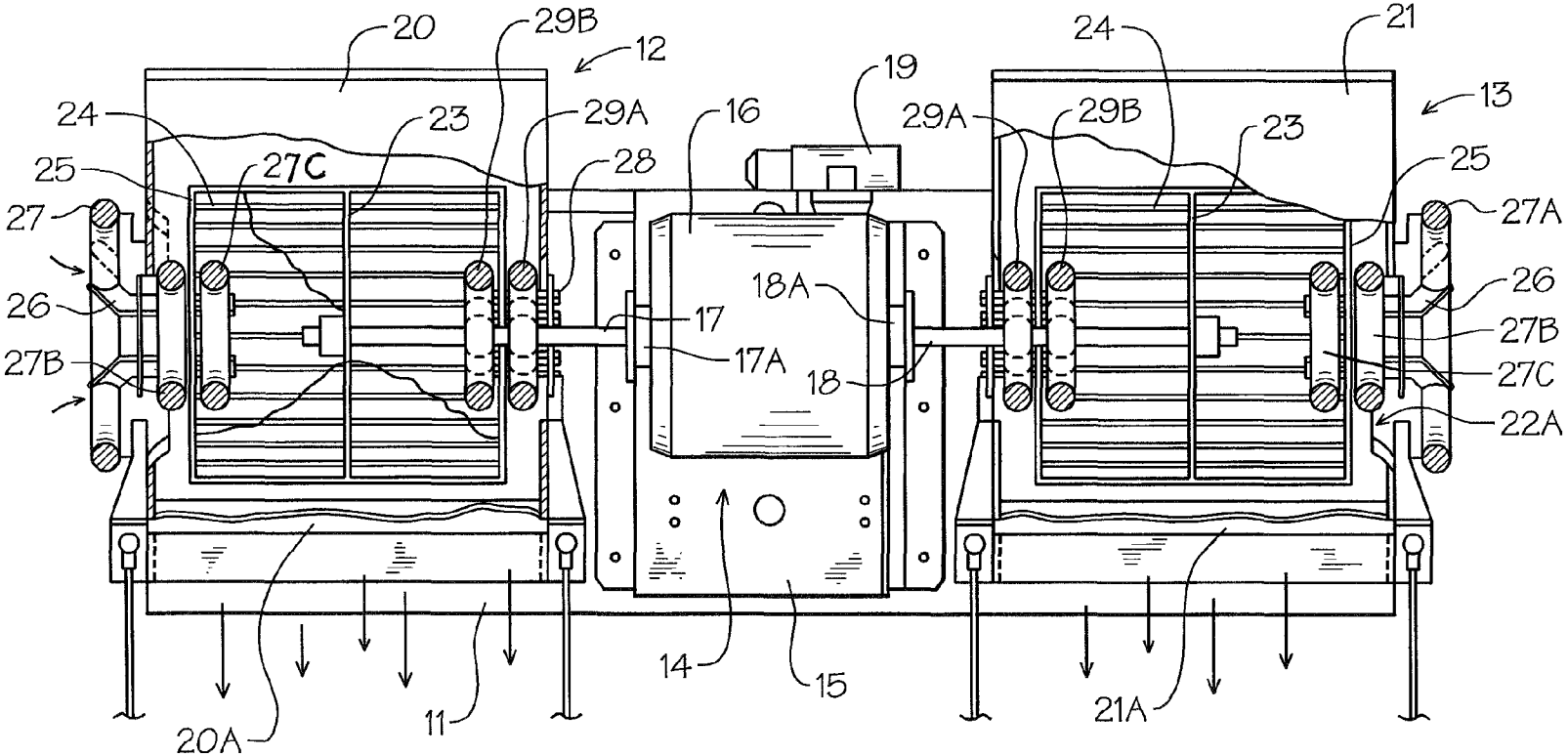
FIG. 1 is a front top elevational view of the air curtain heating system of the invention with portions cut away.

Referring to FIG. 1 of the drawings, an air curtain assembly 10 of the invention can be seen having a generally rectangular support pan 11 with a pair of air blower assemblies 12 and 13 positioned thereon in opposing aligned relation to one another. The air blower assemblies 12 and 13 are identical with an interconnected drive electric motor assembly 14 mounted therebetween for bi-directional driving as will be explained in detail hereinafter.

The electric motor assembly 14 has an upstanding motor support frame mount 15 with an electric drive motor 16 mounted thereon. The drive motor 16 has a pair of oppositely disposed extending power drive shafts 17 and 18 with respective associated bearing assemblies 17A and 18A and a power is controller 19 as is well known and understood within the art. The power controller 19 is in electrical communication with a power supply motor control circuit C well known and understood within in the art in such industrial applications.

Figure 2:
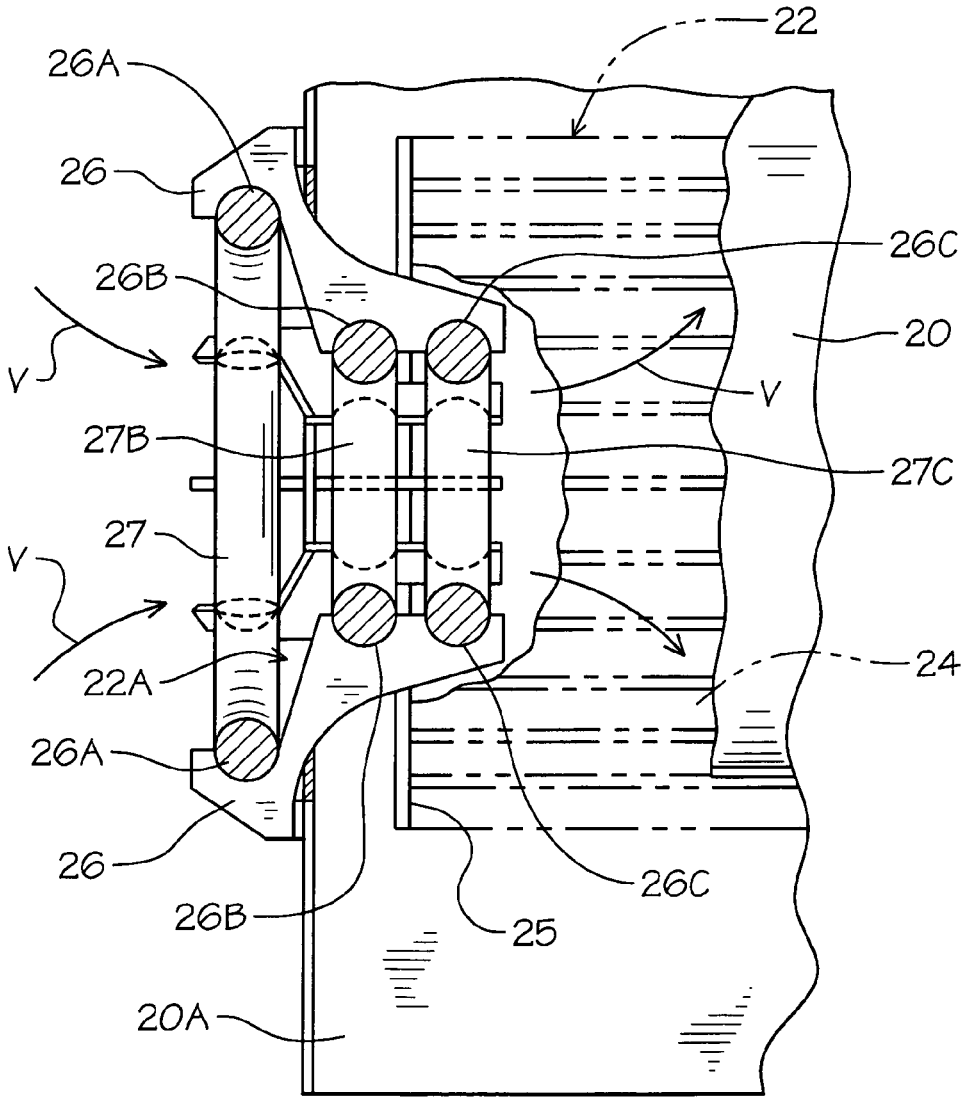
FIG. 2 is an enlarged side elevational view with portions cut away.

As noted, each of the blower assemblies 12 and 13 are identical having a blower housing cylindrical casings 20 and 21 with integrated rectangular extending nozzle outlets 20A and 21A formed thereon secured to the support pan 11 as best seen in FIG. 2 of the drawings. Each air blower has a fan cage 22 supported in rotational relationship therewithin on corresponding respective free ends of the drive shafts 17 and 18 by a central impellor mounting disk 23. Each fan cage 22 comprises a plurality of cross-sectionally contoured impellor blades 24 which are supported, as noted, by the central mounting disk 23 registering annularly thereabout and respective oppositely disposed annular cage end impellor support rings 25 for engagement and support of the corresponding parallel annularly spaced multiple contoured impellor blades 24 fabricated by typical manufacturing methods well known within the art.

Figure 3:
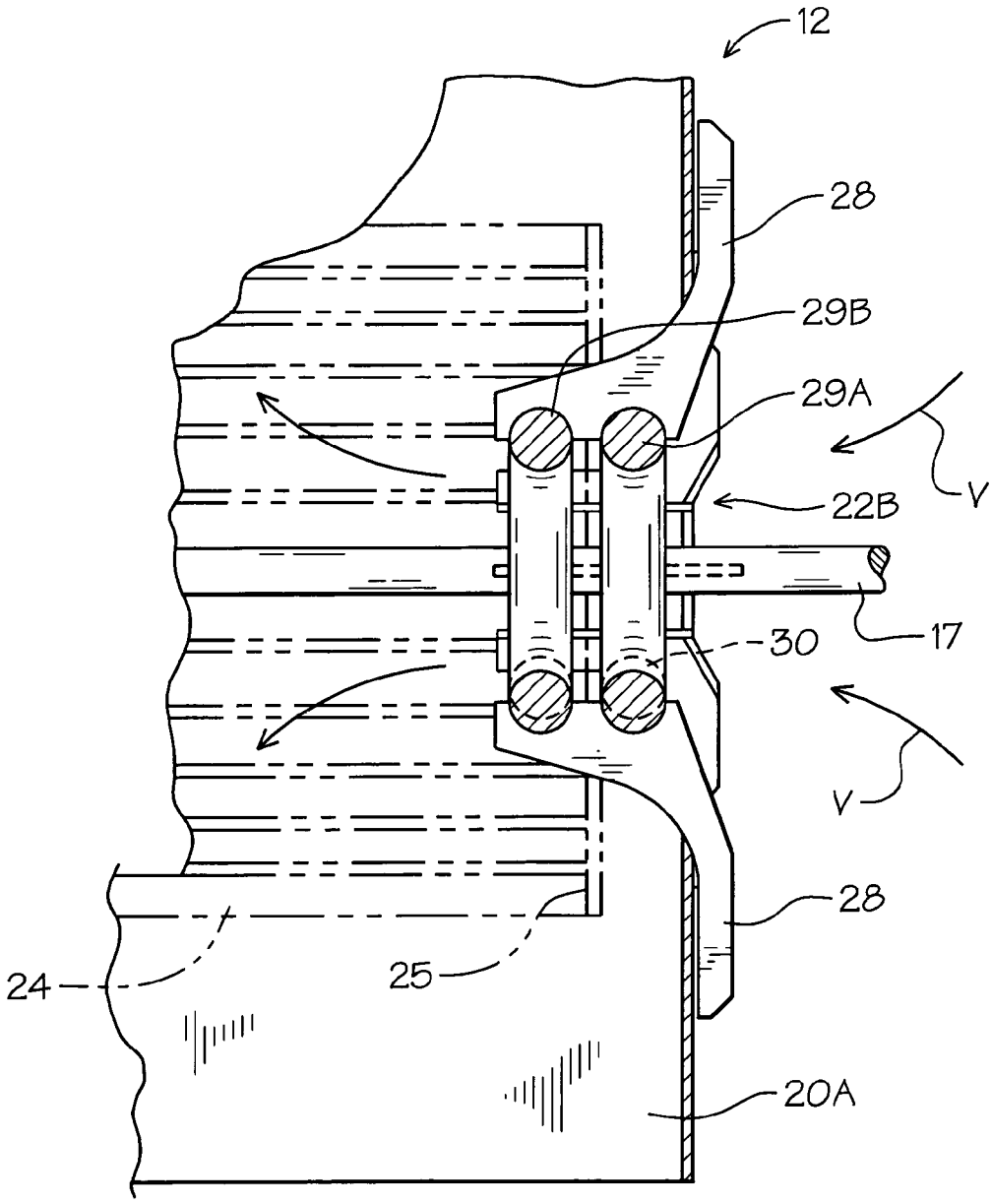
FIG. 3 is an enlarged partial side elevational view with portions cut away of an outer heating coil assembly positioned within the fan cage.
Figure 4:
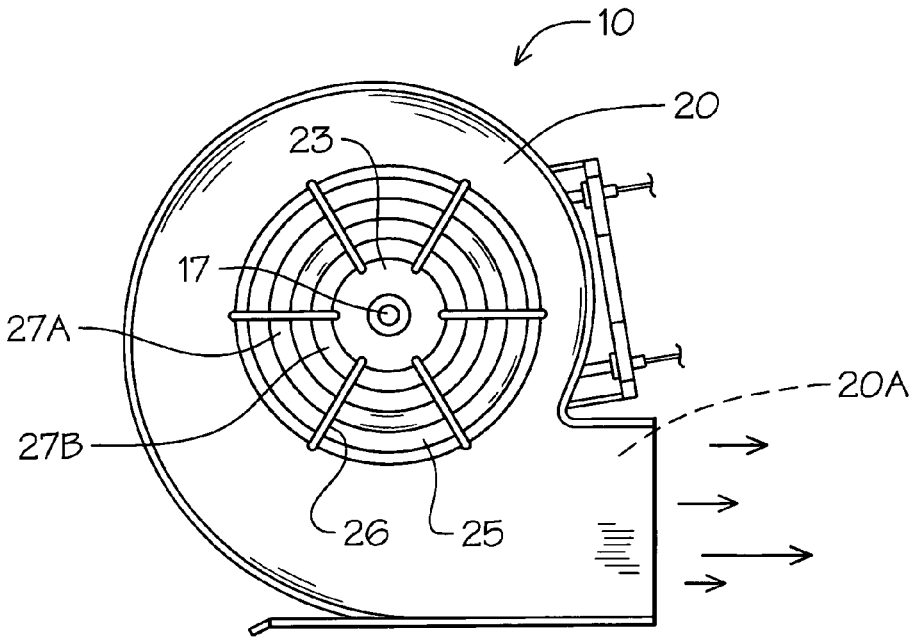
FIG. 4 is an enlarged partial end elevational view thereof.

Outer end multiple heating coil mounting brackets 26, best seen in FIGS. 1, 2 and 3 of the drawings are fitted within respective open ends 22A of the fan cages 22.

The mounting brackets 26 support multiple annular spaced coil engagement elements 27, each bracket having multiple half arcuate coil receiving notches 26A, 26B and 26C therewithin. The mounting brackets 26 extend from outside the impellor's fan cage 22 inwardly holding the assistant heating coils 27A, 27B and 27C of different annular dimensions.

In this example, the coils 27B and 27C are of identical dimension with coil 27A of an increased diameter dimension so as to form a venturi shaped air intake flow V (illustrated by flow arrows) feeding into and within the fan cages 22 during operational rotation by the drive shafts 17 and 18 as hereinbefore described.

Referring now to FIG. 3 of the drawings, the "inner" inside end mounting coil configuration can be seen on the blower assembly 12 wherein modified coil mounting brackets 28 are positioned in spaced annular relation to mount respective split heating coils 29A and 29B inside the respective cage ends 22B facing the aforedescribed drive motor 16. The heating coils 29A and 29B are split with a gap at 30 allowing insertion and removal around the respective drive shaft extensions 17 and 18 passing through the center of the coils to the central mounting disks 23 on the drive shaft's respective free ends and the electric motor 16, as noted. Given the reduced coil diameter of the inside end coils 29A and 29B so positioned within the respective cage ends 22B, a venturi shaped inflow airstream V is also created therewithin with the associated enhanced efficiency and economy of co-laminar airflow over the coils for maximum heat transfer with the cage ends 22B.

Figure 5:
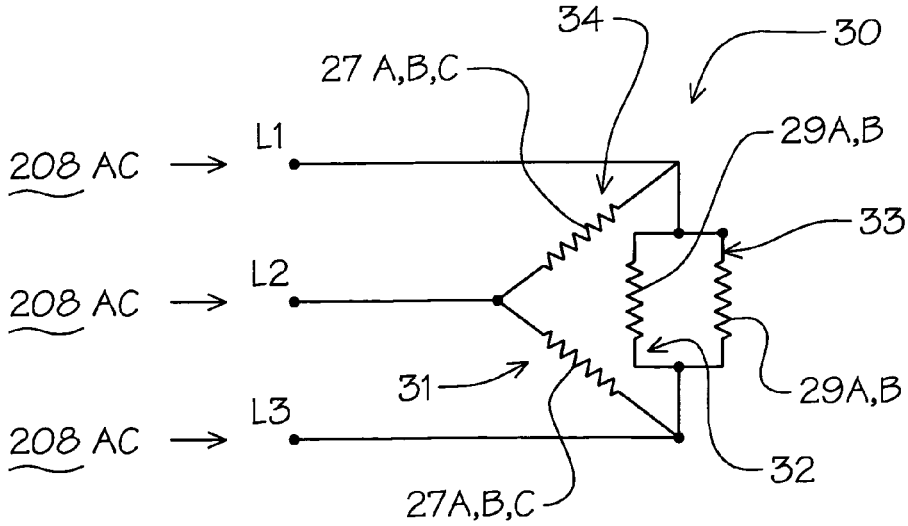
FIG. 5 is a graphic illustration of the three phase power supply circuit associated with the energization of the multiple heating coil assemblies therewith.

Referring now to FIG. 5 of the drawings, an electrical supply coil energizing circuit 31 is graphically illustrated for distributing measured equal power supply to the multiple heating coils defined for clarity as outside coil assemblies 31 and 34 and corresponding inner heating coil assemblies 32 and 33 shown graphically. As noted, each of the heating coil assemblies 31, 32, 33 and 34 have multiple coils hereinbefore described as outside coil element pairs 27A, 27B, 27C and inside coil element pairs 29A and 29B within respective coil assemblies 31 and 34 and 32 and 33 noted.

It will be seen when a three phase commercial power source is used defined in the graphic electrical supply circuit 31 as L1, L2 and L3 each of, in this example, 208 volts the outside coil pair assemblies 31 and 34 are supplied by L2 at approximately 4.66 kw each and the inside coil pair coil assemblies 32 and 33 are supplied in parallel at 2.33 kw each thus defining an equal power supply of 4.66 kw each coil configuration as will be understood by those skilled in the art.

It will be evident that the hereinbefore described integrated inner venturi heaters for air curtains provides a unique combination of integrated fan inclusively positioned airflow determinant heating coil assemblies in the respective ends of corresponding impellor fan cages of blower assembly used within an air curtain configuration to impart a modified venturi air intake effect over the respective heating coil surfaces for increased efficiency and enhanced heat transfer with the utilization of a unique three power phase supply electrical energy distribution into corresponding four coil assembly use of equal power intake available only in the configuration set forth in the above referred to description and embodiment.

It will thus be evident that a new and novel air curtain venturi integrated heater configurations have been illustrated and described and it will be apparent to those skilled in the art that various changes and modifications may be made therein without departing from the spirit of the invention.

Therefore we claim:

1. Integrated heating coil units for an air curtain comprises, an air curtain having a plurality of blower units, an impellor cage rotatable within each of said respective blower units, an electric motor coupled to said impellor cages for generating an air flow therethrough, first and second heating coil assemblies, said first heating coil assembly mounted adjacent to each said respective impellor cage and said second heating coil assembly mounted within each of said respective impellor cage, defining a central inner intake airflow pattern therewithin, each blower unit including a hollow housing about each impellor cage, a directional nozzle outlet associated with each of said blower housings and a source of power for respective heating coil assemblies.

2. The integrated heating coil units for an air curtain set forth in claim 1 wherein said hollow housings having oppositely disposed open ends forming respective inflow air inlets in which one of said heating coil assemblies are positioned.

3. The integrated heating coil units for an air curtain set forth in claim 1 wherein said heating coil assemblies comprise, said first heating coil assembly having increased annular dimension outside of said respective hollow housings and said second heating coil assembly having multiple axially aligned coils in spaced relation to one another within said respective hollow housings and said impellors.

4. The integrated heating coil unit for an air curtain set forth in claim 1 wherein said intake airflow pattern is of a configuration within and defined by said respective heating coil assemblies within said and without corresponding blower units.

5. The integrated heating coil unit for an air curtain set forth in claim 1 wherein said source of power for said respective multiple heating coils comprises, a heater energizing circuit having multiple heat coil distribution power values of balanced power from a power source.

* * * * *